US007963452B2

(12) United States Patent
Moritz

(10) Patent No.: US 7,963,452 B2
(45) Date of Patent: Jun. 21, 2011

(54) RFID TAG ASSEMBLY

(75) Inventor: Colin B. Moritz, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 32 days.

(21) Appl. No.: 12/521,415

(22) PCT Filed: Sep. 11, 2007

(86) PCT No.: PCT/US2007/078182

§ 371 (c)(1),
(2), (4) Date: Aug. 25, 2009

(87) PCT Pub. No.: WO2008/033855

PCT Pub. Date: Mar. 20, 2008

(65) Prior Publication Data

US 2010/0090012 A1 Apr. 15, 2010

Related U.S. Application Data

(60) Provisional application No. 60/844,343, filed on Sep. 11, 2006.

(51) Int. Cl.
*G06K 19/06* (2006.01)

(52) U.S. Cl. ..... 235/492; 235/383; 235/439; 340/572.1; 340/572.8

(58) Field of Classification Search ..... 235/492, 235/383, 439; 340/572.1, 572.8
See application file for complete search history.

(56) References Cited

U.S. PATENT DOCUMENTS

| | | | | |
|---|---|---|---|---|
| 5,142,128 | A | 8/1992 | Perkin et al. | |
| 5,202,680 | A | 4/1993 | Savage | |
| 5,360,967 | A | 11/1994 | Perkin et al. | |
| 5,963,132 | A | 10/1999 | Yoakum | |
| 6,039,497 | A | 3/2000 | Gullberg | |
| 6,067,016 | A | 5/2000 | Deschenes et al. | |
| 6,239,737 | B1 * | 5/2001 | Black | 342/51 |
| 6,347,292 | B1 | 2/2002 | Denny et al. | |
| 6,480,811 | B2 | 11/2002 | Denny et al. | |
| 6,604,063 | B2 | 8/2003 | Denny et al. | |
| 2002/0014966 | A1 | 2/2002 | Strassner, II et al. | |
| 2003/0156033 | A1 | 8/2003 | Savage et al. | |
| 2004/0030501 | A1 | 2/2004 | Denny et al. | |
| 2004/0074974 | A1 | 4/2004 | Senba et al. | |
| 2005/0174241 | A1 | 8/2005 | Olsen | |
| 2006/0049945 | A1 | 3/2006 | Tanaka et al. | |
| 2006/0214791 | A1 * | 9/2006 | Tethrake et al. | 340/572.1 |
| 2009/0078762 | A1 * | 3/2009 | Forster et al. | 235/385 |

FOREIGN PATENT DOCUMENTS

| | | |
|---|---|---|
| WO | WO03062588 | 7/2003 |

OTHER PUBLICATIONS

PCT International Search Report for Appl. No. PCT/US2007/078182 dated Apr. 2, 2008; (pp. 2).

Australian Examination Report issued Sep. 21, 2010, Application No. 2007296561 (2 pp).

* cited by examiner

*Primary Examiner* — Allyson N Trail
(74) *Attorney, Agent, or Firm* — Conley Rose, P.C.

(57) ABSTRACT

An RFID tag assembly for tagging an asset comprises a housing including an inner cavity and a through bore. In addition, the assembly comprises an RFID tag disposed in the inner cavity. Further, the assembly comprises a mounting member coaxially disposed in the bore. The mounting member includes a threaded portion that extends from the lower surface of the housing and is adapted to threadingly coupled the housing to the asset.

23 Claims, 4 Drawing Sheets

RFID TAG ASSEMBLY

STATEMENT REGARDING FEDERALLY SPONSORED RESEARCH OR DEVELOPMENT

Not Applicable.

BACKGROUND

1. Field of the Invention

The invention relates generally to radio-frequency identification (RFID) tags. More particularly, the invention relates to devices and methods for sealing, protecting, and securing RFID tags on assets in the oil and gas industry.

2. Background of the Invention

A radio-frequency identification (RFID) tag is a device attached to, or incorporated into, an object to enable relatively easy and quick identification of the object using radiowaves. Most RFID tags contain at least two parts, an integrated circuit for storing and processing information related to the object to which the tag is attached, and an antenna for receiving and transmitting a signal carrying such information. The information regarding the object is acquired by an RFID reader that may be carried by a user and scanned over or aimed at the tag. Some RFID tags can be read with an RFID reader from a several meters away and/or outside the line of sight of the reader, thereby enhancing the speed and ease with which the object and select characteristics of the object may be identified. For use with goods and products, RFID tags are typically attached to the outside of the object in a location where it can be sufficiently read by an RFID reader.

In general, RFID tags come in three general varieties: passive, active, or semi-passive (also known as battery-assisted). Passive tags require no internal power source, thus being pure passive devices (i.e., they are only active when a reader is nearby to power them), whereas semi-passive and active tags require a power source, usually a small battery. To communicate, RFID tags respond to queries from the RFID reader by generating response signals read by the RFID reader that contain the information about the object to which the RFID tag is attached.

Most conventional RFID tags are designed for use in relatively mild environments such as in retail stores, in vehicles for electronic toll collection, etc. In many cases, the RFID tag is simply attached to the object to be identified with an adhesive or sticker. In addition, many conventional RFID tags are only readable with an RFID reader, as opposed to being visible to a naked eye. In other words, the information regarding the object is not visible, but rather, is contained exclusively in the signal generated by the RFID tag and read by the RFID reader.

In most oil and gas industry applications, the environmental conditions experienced by RFID tags tend to be relatively harsh. For instance, RFID tags are commonly exposed to temperature extremes, corrosive fluids and moisture, vibrations and impact loads. Such conditions can result in degradation and/or damage to conventionally unprotected and unsecured RFID tags. In some cases, the coupling between the RFID tag to the object may wear away or be overcome by vibrations and/or impact loads, resulting in the RFID tag becoming completely separated from the object for which it was intended. Moreover, in some situations, it may be desirable to visually identify the object in the field when an RFID reader is not readily accessible.

Accordingly, there remains a need in the art for RFID tags particularly adapted for use in relatively harsh, rugged environments likely to be experienced in the oil and gas industry.

Such RFID tags would be particularly well received if they offered the potential for improved durability, a more reliable and secure coupling to the object, and direct visualization identification in such harsh environments.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
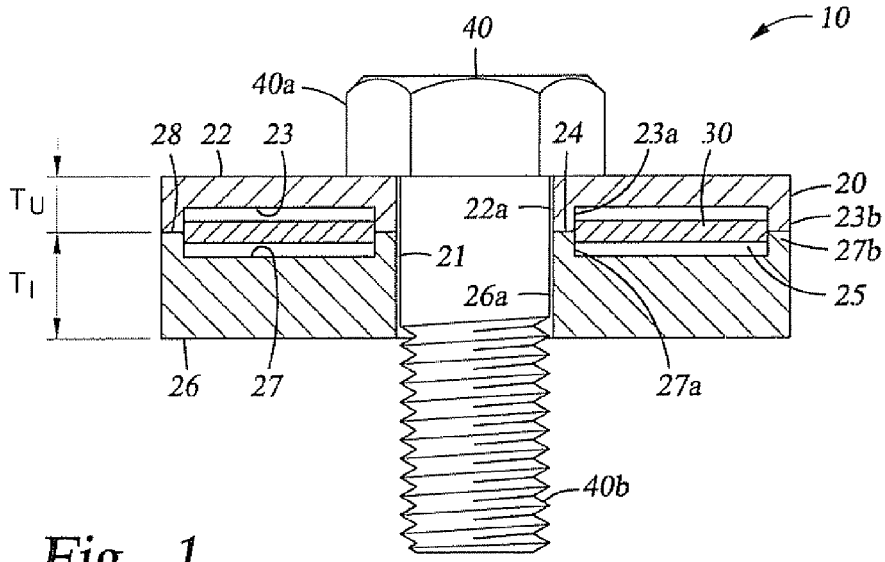
FIG. 1 is a front cross-sectional view of an embodiment of an RFID tag assembly constructed in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections.

Figure 2:
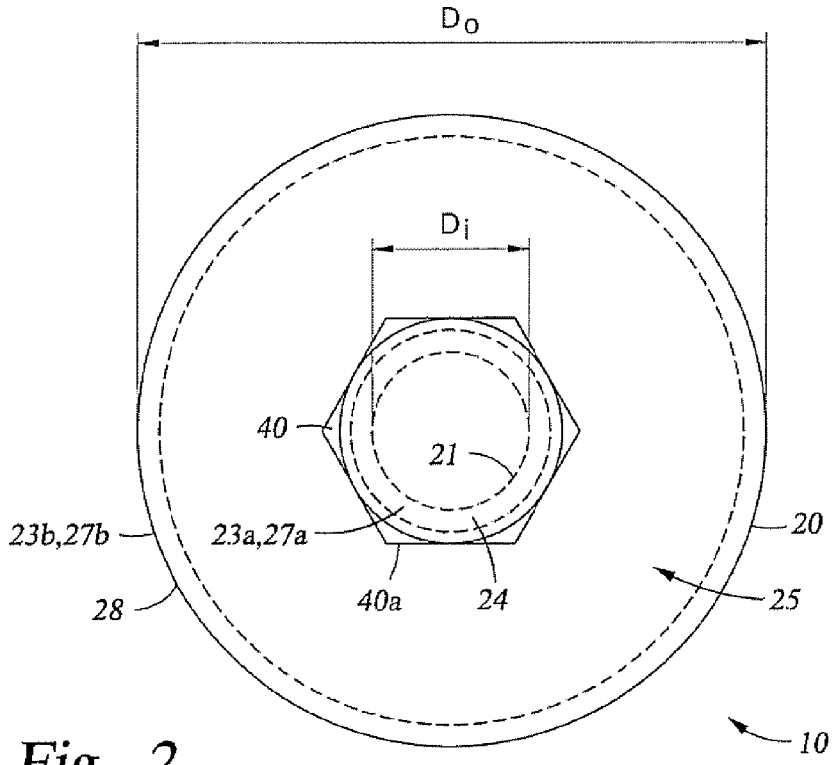
FIG. 2 is a top view of the RFID tag assembly of FIG. 1.

Referring now to FIGS. 1 and 2, an embodiment of an RFID tag assembly 10 for identifying an asset is shown. Exemplary assets include, without limitation, a piece of equipment, a system component, a part, etc. RFID tag assembly 10 comprises an annular housing 20, an RFID tag 30 disposed within housing 20, and a mounting member 40 to releasably couple housing 20 and RFID tag 30 to the asset to be identified.

Housing 20 includes a central through bore 21 through which mounting member 40 is coaxially and slidingly disposed, and an inner annular cavity 25 within which RFID tag 30 is disposed. In this particular embodiment, housing 20 is formed by a first or upper annular member 22 coupled to a second or lower annular member 26. Upper member 22 includes a central through bore 22*a* that is coaxially aligned with a central through bore 26*a* provided in lower member 26. Together, bores 22*a*, 26*a* define bore 21 having a substantially uniform diameter.

In this embodiment, members 22, 26 have substantially the same outer diameter $D_o$ and substantially the same inner diameter $D_i$ defining bores 22*a*, 26*a*, respectively. In addition, upper member 22 has an axial thickness $T_u$ and lower member 26 has an axial thickness $T_l$. In this embodiment, thickness $T_l$ is greater than thickness $T_u$.

The interfacing surfaces of members 22, 26 include opposed recesses 23, 27, respectively, that face each other and define cavity 25. In addition, recesses 23, 27 define radially inner mating annular ridges 23*a*, 27*a* and radially outer mating annular ridges 23*b*, 27*b* on the interfacing surfaces of members 22, 26, respectively. Inner ridges 23*a*, 27*a* engage each other proximal the inner radius of members 22, 26 to form a radially inner seal 24 therebetween, and outer ridges 23*b*, 27*b* engage each other along the outer perimeter of members 22, 26 to form a radially outer seal 28 therebetween. Since members 22, 26 are not intended to move rotationally or translationally relative to each other, seals 24, 28 may also be referred to herein as "static seals". Seals 24, 28 are preferably 360° fluid tight seals, and more preferably, 360° air-tight seals that completely isolate cavity 25 from the environment outside assembly 10, thereby protecting RFID tag 30 from potentially damaging moisture and/or corrosive fluids. Seals 24, 28 may be formed by any suitable means including, without limitation, mating surfaces compressed together (with or without a gasket disposed therebetween), a chemical bond, an adhesive, a mechanical bond, or combinations thereof.

Referring still to FIGS. 1 and 2, mounting member 40 is slidingly disposed through bore 21 and securely couples housing 20 and RFID tag 30 to an asset. Mounting member 40 is preferably configured to releasably couple housing 20 to the asset to be identified, thereby enabling re-use of housing 20 and RFID 30.

In this embodiment, mounting member 40 is a stud or bolt comprising an upper head 40*a* and a lower threaded portion 40*b* extending therefrom. Head 40*a* engages the upper surface of housing 20 and threaded portion 40*b* is threadingly disposed in a mating bore provided in the asset or on an intermediary body (e.g., bracket) that is ultimately mounted to the asset. In this manner, housing 20 and RFID tag 30 are securely and releasably coupled (directly or indirectly) to the asset. Further, it should be appreciated that as bolt 40 is threadingly tightened, inner ridges 23*a*, 27*a* are compressed together, and outer ridges 23*b*, 27*b* are compressed together, thereby enhancing the sealing engagement between members 22, 26 at seals 24, 28. In addition, threaded portion 40*b* provides a relatively simple, convenient, and robust means to couple housing 20 to the asset.

RFID tag 30 is disposed between members 22, 26 within cavity 25. RFID tag 30 may comprise any conventional RFID tag including, without limitation, passive, active, or semi-active RFID tag. Cavity 25 within which RFID tag 30 is disposed preferably comprises air, vacuum, or other gas that provides little to no radio interference with the RFID tag's antenna. Further, RFID tag 30 may be free-floating within cavity 25 or held in place with a cushioning material such as foam.

In general, RFID tags are typically relatively flat and thin, ranging in total thickness from about paper thin to over 0.25 in. thick. Thus, to accommodate RFID tag 30, cavity 25 preferably has a thickness, measured axially between recesses 23, 27, between about 0.001 in. and about 0.50 in.

In general, the size and geometry of members 22, 26 may vary depending on a variety of factors including, without limitation, the application of tag 10, the potential loads (e.g., impact loads), the size of the RFID tag disposed therebetween, or combinations thereof. However, for sufficient strength and rigidity under compression while accommodating RFID tag 30, the outer diameter $D_o$ of each member 22, 26 is preferably between about 0.5 in. and 2 in., and the thickness $T_u$, $T_l$ of member 22, 26, respectively, is preferably between about 0.0625 in. and 1 in. Still further, bore 21 may have any suitable diameter sufficient to accommodate bolt 40. However, for use with readily available bolts, members 22, 26 preferably each have an inner diameter $D_i$ between about 0.25 in. and 0.75 in.

In general, the components of assembly 10 (e.g., members 22, 26, mounting member 40, etc.) may comprise any suitable materials. However, the components of assembly 10 preferably comprise materials that provide minimal or no interference with RFID tag radio signals or waves and that are sufficiently tough and durable for extended use in relatively harsh environments expected in the oil and gas industry where corrosive chemicals and vapors, and water are often encountered. An example of a suitable material is an environmentally stable plastic.

Member 22 and/or member 26 may optionally comprise a semi or fully transparent material that permits direct visualization of the contents of cavity 25. For instance, a visual identifier may be placed in cavity 25 between the RFID tag 30 and the upper member 22 and directly viewed through a transparent upper member 22. In general, a visual identifier may include, without limitation, a color code, a barcode, printed text or numbers, or combinations thereof that the asset to be visually identified to some degree without scanning the RFID tag. In other embodiments, the visual identifier may simply be placed on the upper, outer surface of member 22 for direct visualization.

Although housing 20 and cavity 25 have been described as annular, it should be appreciated that other suitable geometries other than circular or round (e.g., rectangular, triangular, etc.) may also be employed. Further, although mounting member 40 is shown and described as a bolt, in general, mounting member 40 may comprise any suitable device for securely coupling housing 20 to the asset, such as an extending stud (threaded or otherwise) suitably attached to the asset. Mounting member 40 preferably forms a coupling of sufficient strength and rigidity to withstand the potential impact loads and vibrations experience in oil and gas industry applications. In other words, mounting member 40 preferably maintains a secure coupling to the asset through harsh conditions.

Figure 3:
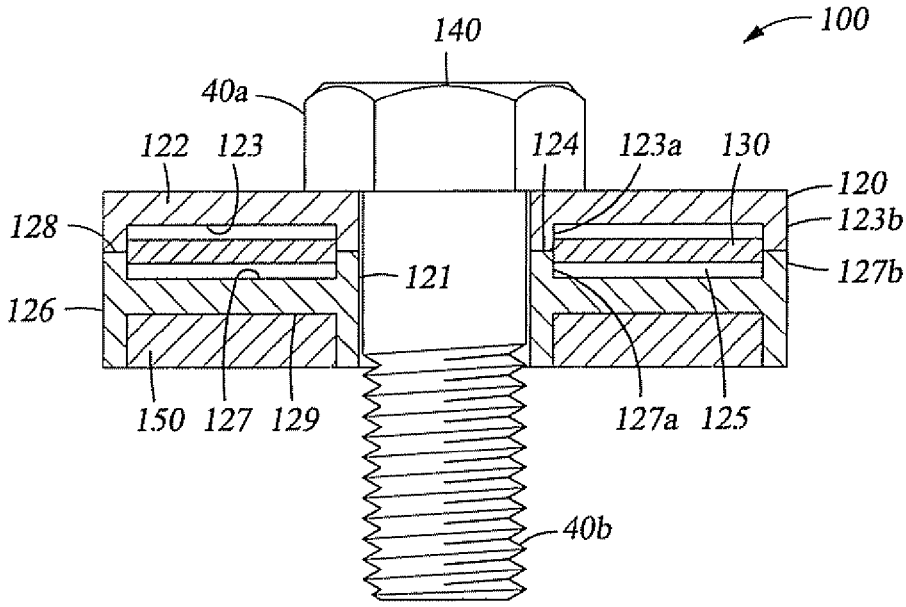
FIG. 3 is a front cross-sectional view of another embodiment of an RFID tag assembly constructed in accordance with the principles described herein.

Referring now to FIG. 3, another embodiment of an RFIP tag assembly 100 is shown. Assembly 100 is substantially the same as assembly 10 previously described. Namely, assembly 100 includes an annular housing 120, an RFID tag 130 disposed within housing 120, and a mounting member 140 adapted to couple housing 120 and RFID tag 130 to the asset to be identified. Housing 120 includes a central through bore 121 through which mounting member 140 is coaxially and slidingly disposed, and an inner annular cavity 125 within which RFID tag 130 is disposed. In addition, housing 120 is formed by an upper annular member 122 coupled to a lower annular member 126. The interfacing surfaces of members 122, 126 include opposed recesses 123, 127, respectively, that define cavity 125, inner ridges 123*a*, 127*a* that sealingly engage, and outer ridges 123*b*, 127*b* that sealingly engage to form a radially inner seal 124 and a radially outer seal 128, respectively.

However, in this embodiment, assembly 100 also includes a resonant tuning member 150 made from a resonant tuning material. In particular, resonant tuning member 150 is annular in shape and is disposed in a mating annular recess 129 provided in the lower surface of member 126. Although resonant tuning member 150 is disposed in recess 129 of member 126 in this embodiment, in other embodiments, resonant tuning member 150 may be positioned and/or coupled to different components of assembly 100 (e.g., member 122). Resonant tuning member 150 offers the potential to enhance the efficiency and/or transmission capability of RFID tag 30.

Figure 4:
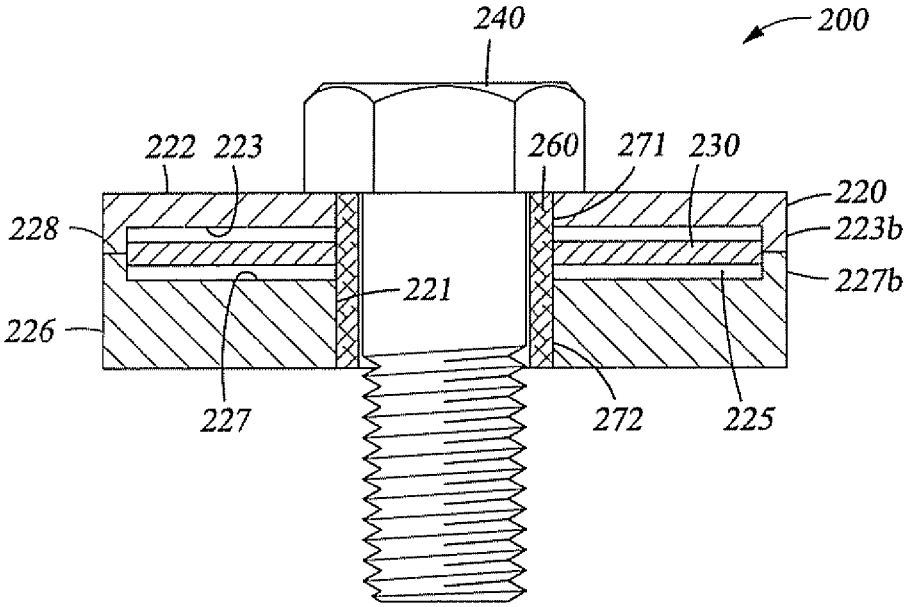
FIG. 4 is a front cross-sectional view of another embodiment of an RFID tag assembly constructed in accordance with the principles described herein.

Referring now to FIG. 4, another embodiment of an RFID tag assembly 200 is shown. Assembly 200 is substantially the same as assembly 10 previously described. Namely, assembly 200 includes an annular housing 220, an RFID tag 230 disposed within housing 220, and a mounting member 240 adapted to couple housing 220 and RFID tag 230 to the asset to be identified. Moreover, housing 220 includes a central through bore 221 through which mounting member 240 is coaxially disposed, and an inner annular cavity 225 within which RFID tag 230 is disposed. In addition, housing 220 is formed by an upper annular member 222 coupled to a lower annular member 226. The interfacing surfaces of members 222, 226 include opposed recesses 223, 227, respectively, that define cavity 225.

In this embodiment, recesses 223, 227 form a radially outer ridges 223*b*, 227*b* that sealingly engage to form a radially outer seal 228, however, recesses 223, 227 extend completely to the inner radius of members 222, 226, respectively. Consequently, members 222, 226 do not include radially inner mating ridges. Rather, in this embodiment, assembly 200 also includes a cylindrical sleeve 260 coaxially disposed between mounting member 240 and members 222, 226. Sleeve 260 sealingly engages the inner radial surfaces of each member 222, 226 to form radially inner seals 271, 272, respectively. In this manner, seals 228, 271, 272 separate cavity 225 from the environment outside assembly 200.

Seals 271, 272 between sleeve 260 and members 222, 226, respectively, may be formed by any suitable means. In this particular embodiment, sleeve 260 is bonded to the inner radial surfaces of members 222, 226 to form seals 271, 272. In addition to forming seals 271, 272, sleeve 260 also, at least partially, supports the compressional loads applied to housing 220 by mounting member 240, thereby reducing the likelihood of damage to housing 220 in the case of excessive compression loads.

Figure 5:
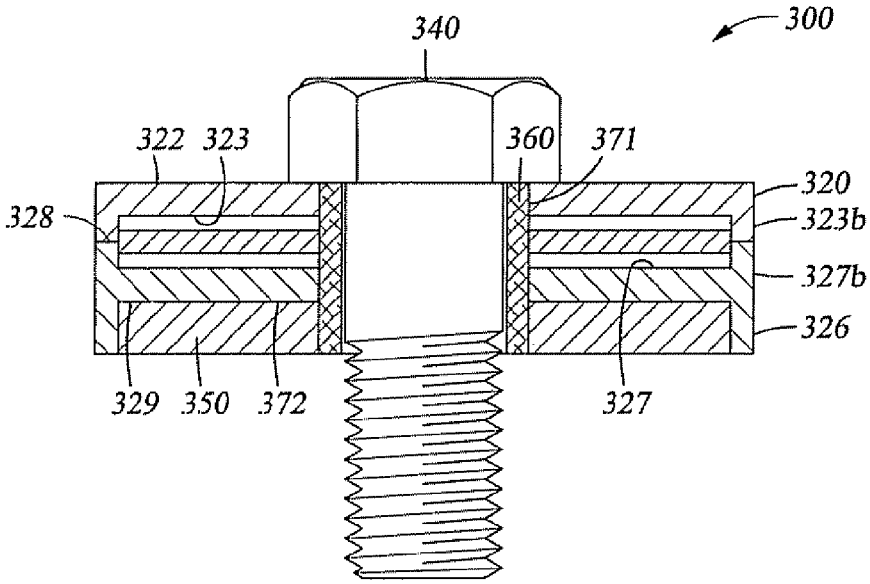
FIG. 5 is a front cross-sectional view of another embodiment of an RFID tag assembly constructed in accordance with the principles described herein.

Referring now to FIG. 5, another embodiment of an RFID tag assembly 300 is shown. Assembly 300 is substantially the same as assembly 200 previously described. Namely, assembly 300 includes an annular housing 320, an RFID tag 330 disposed within a cavity 325 in housing 320, and a mounting member 340 adapted to couple housing 320 and RFID tag 330 to the asset to be identified. Housing 320 is formed by an upper annular member 322 coupled to a lower annular member 326. The interfacing surfaces of members 322, 326 include opposed recesses 323, 327, respectively, that define cavity 325. Recesses 323, 327 form a radially outer ridges 323*b*, 327*b* that sealingly engage to form a radially outer seal 328. A cylindrical sleeve 360 coaxially disposed between mounting member 340 and members 322, 326 sealingly engages the inner radial surfaces of each member 322, 326 to form radially inner seals 371, 372, respectively.

However, in this embodiment, assembly 300 also includes a resonant tuning member 350 similar to resonant tuning member 150 previously described. Resonant tuning member 350 is made from a resonant tuning material and is disposed in an annular mating recess 329 provided in the lower surface of member 326. In this embodiment, the radially inner surface of resonant tuning member 350 engages the cylindrical outer surface of sleeve 360.

Figure 6:
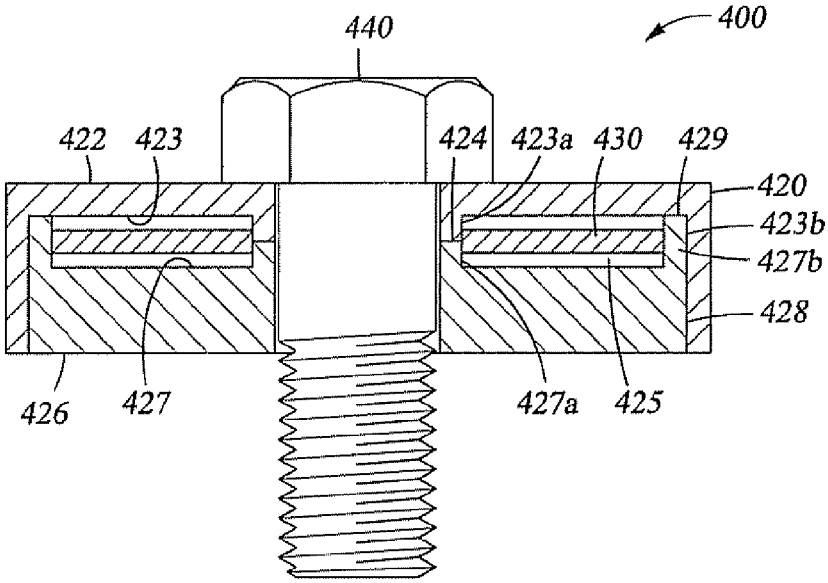
FIG. 6 is a front cross-sectional view of another embodiment of an RFID tag assembly constructed in accordance with the principles described herein.

Referring now to FIG. 6, another embodiment of an RFIP tag assembly 400 is shown. Assembly 400 is substantially the same as assembly 10 previously described. Namely, assembly 400 includes an annular housing 420, an RFID tag 430 disposed within housing 420, and a mounting member 440 adapted to couple housing 420 and RFID tag 430 to the asset to be identified. Housing 420 includes a central through bore 421 through which mounting member 440 is coaxially and slidingly disposed, and an inner annular cavity 425 within which RFID tag 430 is disposed. In addition, housing 420 is formed by an upper annular member 422 coupled to a lower annular member 426. The interfacing surfaces of members 422, 426 include opposed recesses 423, 427, respectively, that define cavity 425, and inner ridges 423*a*, 427*a* that sealingly engage to form an inner annular seal 424.

However, in this embodiment, members 422, 426 have substantially the same inner diameter, but upper member 422 has an outer diameter that is slightly greater than the outer diameter of lower member 422. In particular, recess 423 in upper member 422 defines an annular outer ridge 423*b* that extends axially along, and engages, the outer radial surface of lower member 422. In this embodiment, outer ridge 423*b* sealingly engages lower member 422 to form an annular seal 428. In addition, recess 427 in lower member 426 defines an annular outer ridge 427*b* that extends axially to, and engages, the upper surface of recess 423 in upper member 422. In this embodiment, outer ridge 427*b* sealingly engages recess 423 to form an annular seal 429. It should be appreciated that assembly 400 may offer the potential for enhanced sealing at the outer perimeter of members 422, 426 since ridges 423*b*, 427 overlap to form a lapped joint seal 428 having an increased sealing surface area as compared to a conventional butt joint.

Figure 7:
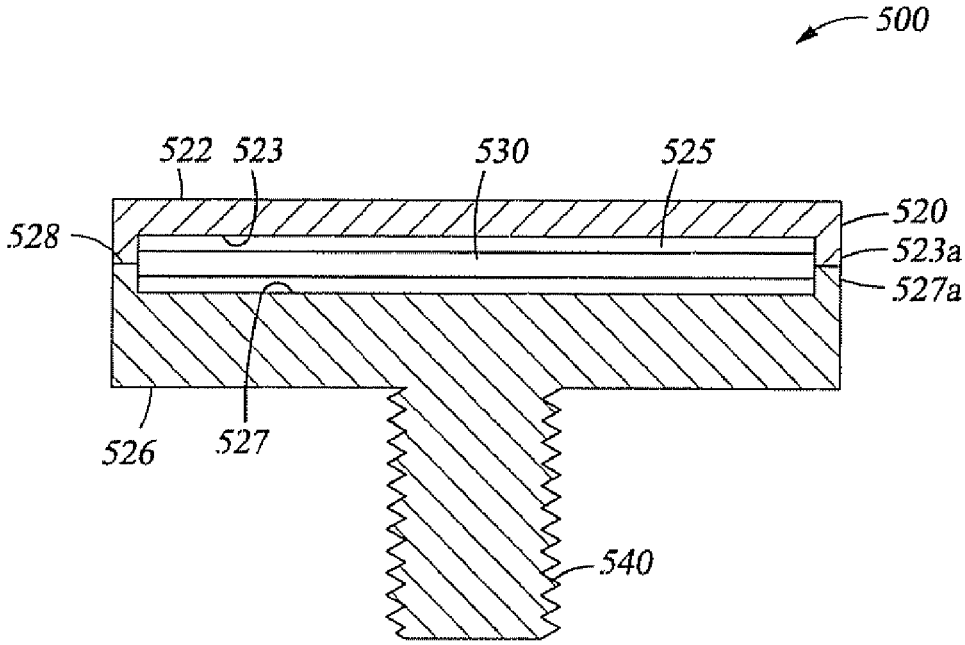
FIG. 7 is a front cross-sectional view of another embodiment of an RFID tag assembly constructed in accordance with the principles described herein.

Referring now to FIG. 7, another embodiment of an RFID tag assembly 500 is shown. Assembly 500 comprises a generally cylindrical housing 520, an RFID tag 530 disposed within housing 520, and a mounting member 540 that releasably couples housing 520 and RFID tag 530 to the asset to be identified. Housing 520 is formed by an upper cylindrical member 522 coaxially coupled to a lower cylindrical member 526. The interfacing surfaces of members 522, 526 include opposed recesses 523, 527, respectively, that define cavity 525. Recesses 523, 527 form a radially outer lips or ridges 523*a*, 327*a* that sealingly engage to form a radially outer seal 528.

Unlike assembly 10 previously described, in this embodiment, no through bores are provided in members 522, 526. Rather, in this embodiment, mounting member 540 is integral with lower member 526, and extends axially away from the outer surface of lower member 526. It should be appreciated that since mounting member 540 does not compress members 522, 526 together when coupled to the asset, seal 528 may be enhanced by alternative means such as bonding.

In the manner described, embodiments of RFID tag assemblies described herein (e.g., RFID tag assemblies 10, 100, 200, etc.) offer the potential for improved durability, convenience, and reliability as compared to some conventional RFID tag assemblies. In some embodiments, a visual identifier and a transparent or semi-transparent housing may be employed to facilitate relatively quick visual identification without the need for an RFID reader. Although embodiments described herein are particularly suited for the relatively harsh conditions encountered in oil and gas operations, they may also be used in other industries and environments. Further, embodiments described herein may be employed with passive, active, or semi-active RFID tags, and further, may be configured for short, medium, or long range scanning.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. An RFID tag assembly for tagging an asset comprising:

a housing having an uppermost outer surface, a lowermost outer surface opposite the uppermost outer surface, an inner cavity disposed between the uppermost outer surface and the lowermost outer surface, and a through bore extending through the housing from the uppermost outer surface to the lowermost outer surface;

an RFID tag disposed in the inner cavity;

a mounting member extending coaxially through the bore, wherein the mounting member includes a head that engages the uppermost outer surface of the housing and a threaded portion that extends from the lowermost outer surface of the housing and is adapted to threadingly coupled the housing to the asset.

2. The RFID tag assembly of claim 1 wherein the housing comprises:

a first member having a lower surface including a first recess and an outer ridge extending along the entire perimeter of the lower surface;

a second member having an upper surface including a second recess and an outer ridge extending along the entire perimeter of the upper surface;

wherein the second member is coupled to the first member such that the second recess opposes the first recess defining an inner cavity between the first member and the second member;

an air-tight seal positioned between the outer ridge of the first member and the outer ridge of the second member.

3. The RFID tag assembly of claim 2 wherein the first member includes a first through bore coaxially aligned with a second through bore in the second member to form the bore in the housing.

4. The RFID tag assembly of claim 3 wherein the inner cavity is positioned radially between the mounting member and the air-tight seal.

5. An RFID tag assembly for tagging an asset comprising:

a first member having a lower surface including a first recess;

a second member having an upper surface including a second recess;

wherein the second member is coupled to the first member such that the second recess opposes the first recess to form an inner cavity between the first member and the second member;

an substantially air-tight outer seal between the first member and the second member sealing the inner cavity;

an RFID tag disposed in the inner cavity between the first member and the second member; and a mounting member adapted to couple the housing to the asset.

6. The RFID tag assembly of claim 5 wherein the first member further comprises an outer ridge extending along the entire outer perimeter of its lower surface, the second member further comprises an outer ridge extending along the entire outer perimeter of its upper surface, and wherein the outer seal is disposed between the outer ridge of the first member and the outer ridge of the second member.

7. The RFID tag assembly of claim 6 wherein the first member includes a first through bore coaxially aligned with a second through bore in the second member.

8. The RFID tag assembly of claim 7 wherein the mounting member is disposed through the first bore and the second bore.

9. The RFID tag assembly of claim 8 wherein the inner cavity is positioned radially between the mounting member and the outer seal.

10. The RFID tag assembly of claim 8 wherein the mounting member comprises a bolt coaxially disposed through the first and the second bores, wherein the bolt comprises a head that engages the upper surface of the first member and a threaded portion opposite the head that extends from the lower surface of the second member.

11. The RFID tag assembly of claim 9 wherein the lower surface of the first member further comprises an inner ridge extending along the entire perimeter of the first bore, and the upper surface of the second member further comprises an inner ridge extending along the entire perimeter of the second bore, wherein the inner ridge of the first member opposes the inner ridge of the second member.

12. The RFID tag assembly of claim 11 further comprising a substantially inner air-tight seal positioned between the inner ridge of the first member and the inner ridge of the second member.

13. The RFID tag assembly of claim 9 further comprising a cylindrical sleeve extending through the first and second bores between the mounting member and the first and second members.

14. The RFID tag assembly of claim 13 further comprising a first inner air-tight seal between the outer cylindrical surface of the sleeve and the surface of the first member that defines the first bore, and a second inner air-tight seal between the outer cylindrical surface of the sleeve and the surface of the second member that defines the second bore.

15. The RFID tag assembly of claim 5 further comprising a visual identifier disposed in the inner cavity between the RFID tag and the first member, wherein the first member comprises a translucent material.

16. The RFID tag assembly of claim 5 wherein the mounting member includes a threaded portion and is integral with the second member.

17. The RFID tag assembly of claim 5 further comprising a resonant tuning member disposed in a third recess formed in the lower surface of the second member.

18. A method for coupling an RFID tag to an asset comprising:

(a) providing a housing with an inner cavity;

(b) disposing the RFID tag in the inner cavity;

(c) isolating the inner cavity from the environment outside the housing with at least one substantially air-tight seal;

(d) coupling the housing to the asset with a mounting member; and (e) compressing the housing during (d) to form the at least one substantially air-tight seal.

19. The method of claim 18 further comprising forming a through bore in the housing.

20. The method of claim 19 wherein the mounting member comprises a bolt having a head and a threaded portion opposite the head, and (d) further comprises:

passing the bolt through the bore in the housing;

engaging the upper surface of the housing with the head;

extending the threaded portion from the lower surface of the housing; and threadingly engaging the threaded portion of the bolt and a mating bore.

21. The method of claim 20 wherein the housing comprises:

a first member having a lower surface including a first recess and an outer ridge extending along the entire outer perimeter of the lower surface;

a second member having an upper surface including a second recess and an outer ridge extending along the entire outer perimeter of the upper surface;

wherein the second member is coupled to the first member such that the second recess opposes the first recess to form the inner cavity; and wherein the at least one air-tight seal is positioned between the outer ridge of the first member and the outer ridge of the second member.

22. The method of claim 21 further comprising compressing the first ridge and the second ridge together.

23. The method of claim 22 wherein first member includes a first through bore coaxially aligned with a second through bore in the second member to form the bore in the housing, wherein the lower surface of the first member further comprises an inner ridge extending along the entire perimeter of the first bore and the upper surface of the second member further comprises an inner ridge extending along the entire perimeter of the second bore, and wherein a substantially air-tight inner seal is disposed between the inner ridge of the first member and the inner ridge of the second member.

* * * * *